US007810659B2

(12) United States Patent
Ishihara

(10) Patent No.: US 7,810,659 B2
(45) Date of Patent: Oct. 12, 2010

(54) BOOM COMPONENT DISPLAY APPARATUS

(75) Inventor: Hideaki Ishihara, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 0 days.

(21) Appl. No.: 12/329,046

(22) Filed: Dec. 5, 2008

(65) Prior Publication Data

US 2009/0159547 A1 Jun. 25, 2009

(30) Foreign Application Priority Data

Dec. 25, 2007 (JP) ..... 2007-331377

(51) Int. Cl.
*B66C 23/70* (2006.01)

(52) U.S. Cl. ..... 212/177; 212/276

(58) Field of Classification Search ..... 212/177, 212/276, 175
See application file for complete search history.

(56) References Cited

U.S. PATENT DOCUMENTS

| | | | | |
|---|---|---|---|---|
| 4,752,012 | A * | 6/1988 | Juergens | 212/278 |
| 6,744,372 | B1 | 6/2004 | Shaw et al. | |
| 6,843,383 | B2 * | 1/2005 | Schneider et al. | 212/278 |

FOREIGN PATENT DOCUMENTS

| | | | |
|---|---|---|---|
| JP | 52-93061 | | 8/1977 |
| JP | 7-33386 | | 2/1995 |
| JP | 8-133681 | A * | 5/1996 |
| JP | 2000-26073 | | 1/2000 |
| JP | 2002-308568 | A * | 10/2002 |
| JP | 2004-75206 | | 3/2004 |
| JP | 2007-217110 | | 8/2007 |
| JP | 2007-217110 | A * | 8/2007 |

* cited by examiner

*Primary Examiner*—Thomas J. Brahan
(74) *Attorney, Agent, or Firm*—Oblon, Spivak, McClelland, Maier & Neustadt, L.L.P.

(57) ABSTRACT

A boom component display apparatus 1 of the present invention is provided with processing units 4, connector assemblies 6 and a display unit 5. The processing units 4 are installed on each of a plurality of unit booms 11*a* thru 11*g* that compose a boom assembly 3 of a crane 100 and outputs identification information of each unit boom. The connector assemblies 6 transmits the identification information outputted from the processing units 4. The display unit 5 displays a connecting sequence information to show the relation between the connecting sequence of a plurality of unit booms 11*a* thru 11*g* and the identification information of a plurality of unit booms 11*a* thru 11*g*, basing on the identification information sent from the processing units 4 through the connector assemblies 6. By depending upon the boom component display apparatus of the present invention, it is possible to prevent the unit booms from being assembled in the wrong connecting sequences.

5 Claims, 9 Drawing Sheets

FIG. 7

ALLOWABLE CONNECTING SEQUENCE DATA 50M UNIT:M

| UNIT BOOM / PATTERN | BASE SIDE SECTION | ① | ② | ③ | ④ | ⑤ | TOP SIDE SECTION | | BOOM LENGTH |
|---|---|---|---|---|---|---|---|---|---|
| PATTERN 1 | (6) | 3 | 6 | 9 | 9 | 9 | (8) | | 50 |
| PATTERN 2 | (6) | 9 | 3 | 6 | 9 | 9 | (8) | | 50 |
| PATTERN 3 | (6) | 9 | 9 | 9 | 9 | – | (8) | | 50 |

BOOM COMPONENT DISPLAY APPARATUS

BACKGROUND OF THE INVENTION

1. Field of the Invention

The present invention relates to a boom component display apparatus, in those cranes which are provided with such a boom assembly as formed by connecting a plurality of unit booms.

2. Description of the Related Art

Conventionally, such a crane that makes it possible for identification information of each unit boom to be transmitted to its crane main body is known. Such a conventional crane is provided with a processing unit that outputs the identification information of each unit boom, and a communication unit that transmits the identification information sent from the processing unit to a central processing unit that is located on the crane main body. The processing unit and the communication unit are installed on each unit boom respectively. With these arrangements provided, by adding up all unit booms' lengths included in the identification information and sent to the central processing unit, it is possible to find the total length of the boom assembly. And in the same manner, by adding up all unit booms' weights included in the identification information, it is also possible to find the total weight of the boom assembly.

Normally, in a crane that forms a boom assembly by connecting a plurality of unit booms, there are several kinds of the unit boom lengths (for example; 3 m, 6 m, 9 m, 12 m and so forth). In such a case, from a strength viewpoint of the boom assembly, each unit boom should be assembled in accordance with an appropriate connecting sequence. These unit booms are constructed so that they may be used for multipurpose use; for example all the connecting parts of each unit boom are manufactured in accordance with an appropriate standard. Also, these unit booms are made up so that they may be connectable with each other regardless of their connecting sequences. Therefore, even when the boom assembly is assembled in a same length, it may be possible to connect unit booms in varieties of connecting sequences, and it would be possible that the unit booms might not be connected in an appropriate connecting sequence. In this respect, it has been difficult to prevent the unit booms from being connected in the wrong connecting sequences.

SUMMARY OF THE INVENTION

The purpose of the present invention is to provide with a boom component display apparatus that makes it possible to prevent each unit boom from being connected in the wrong connecting sequences.

A boom component display apparatus related to the present invention is composed of processing units, a information transmit means and a display unit. The processing units are installed on each one of a plurality of unit booms forming a crane boom assembly of a crane, and outputs identification informations of the unit booms. The information transmit means transmits the identification information that is output from the processing units. The display unit to which the identification informations transmitted from the processing units through the information transmit means displays connecting sequence information that shows the relation between the connecting sequence of a plurality of the unit booms and the identification information of a plurality of unit booms.

According to this configuration, as the connecting sequence information of the unit booms showing the relation between the connecting sequence and the identification information of a plurality of the unit booms forming a boom assembly is shown on the display unit, an operator can confirm the connecting sequence of the unit booms having the prescribed identification informations. Thus, the operator can easily judge whether the appropriate connecting sequence is conducted or not, accordingly the operator can prevent the unit booms from being connected in the wrong connecting sequence.

A preferred example of the boom component display apparatus of the present invention is explained hereinafter. In this example, a power source connecting means is additionally provided. The power source connecting means electrically connects the processing units of the unit booms in series to the power supply, so that they are electrically connected from a side of a boom base section to a side of a boom top section in turn. The processing units output the identification informations of the unit booms, because they are connected electrically to the power source connecting means. Moreover, the display unit displays the connecting sequence information of the unit booms, regarding a transmitted order of the identification informations that the processing units sent through the information transmit means as a connected order of a plurality of the unit booms.

According to this configuration, as the processing units of the unit booms are connected electrically with each other successively from the side of the boom base section to the side of the boom top section by the power source connecting means, so the identification informations are sent to the display unit in the order beginning with the boom base section located next to the crane main body and ending up with the boom top section. Moreover the display unit can display the relation between the identification informations and the connecting sequence as the connecting sequence of the unit booms by using a receiving order of the identification informations. In this case, the simple configuration like this makes it possible to acquire the relation between the identification informations of the unit booms and the connecting sequence information of the corresponding unit boom.

It is preferable to display the identification informations of a plurality of the unit booms in the same order as that of the connecting sequence of a plurality of the corresponding unit booms.

According to this configuration, as the identification informations of a plurality of the unit booms are displayed in the same order as the connecting sequence of a plurality of the corresponding unit booms, it is easy to check the connecting sequence of the unit booms visually. Accordingly, an operator can easily judge whether the connecting sequence of the unit booms is properly arranged or not.

Next, another preferred example of the boom component display apparatus of the present invention is explained hereinafter. The example is provided with the memory in the display unit, which stores a reference connecting sequence information to display the relation between the connecting sequence of a plurality of the unit booms and the identification informations of a plurality of the corresponding unit booms. This display unit compares the connecting sequence information with the reference connecting sequence information, and then if there exists any discrepancy between both of them, a predetermined warning sign is displayed on the screen.

In this arrangement, if the connected configuration of the assembled boom assembly has a different relation from the one shown by the reference connecting sequence information, the display unit displays a warning sign on the screen. Accordingly, by storing the reference connecting sequence information in the memory of the display unit as an appropriate connecting sequence, if the connecting sequence of the unit booms is not properly conducted, an operator can recognize the situation immediately.

Further, it is preferable to display the reference connecting sequence information on the display unit.

In this arrangement, since the reference connecting sequence information is displayed on the display unit, an operator can visually confirm the reference connecting sequence information and he can compare it with the actual connecting sequence information of the unit booms. Accordingly, by storing the relation showing the appropriate connecting sequence of the unit booms in the memory of the display unit as an appropriate connecting sequence, an operator can identify easily whether the connecting sequence of the unit booms is properly conducted or not.

BRIEF DESCRIPTION OF THE DRAWINGS

FIG. 7 is a table showing the possible connecting sequences of the unit booms when the total length of a boom assembly is 50 meters;

DETAILED DESCRIPTION OF THE PREFERRED EMBODIMENTS

Figure 1:
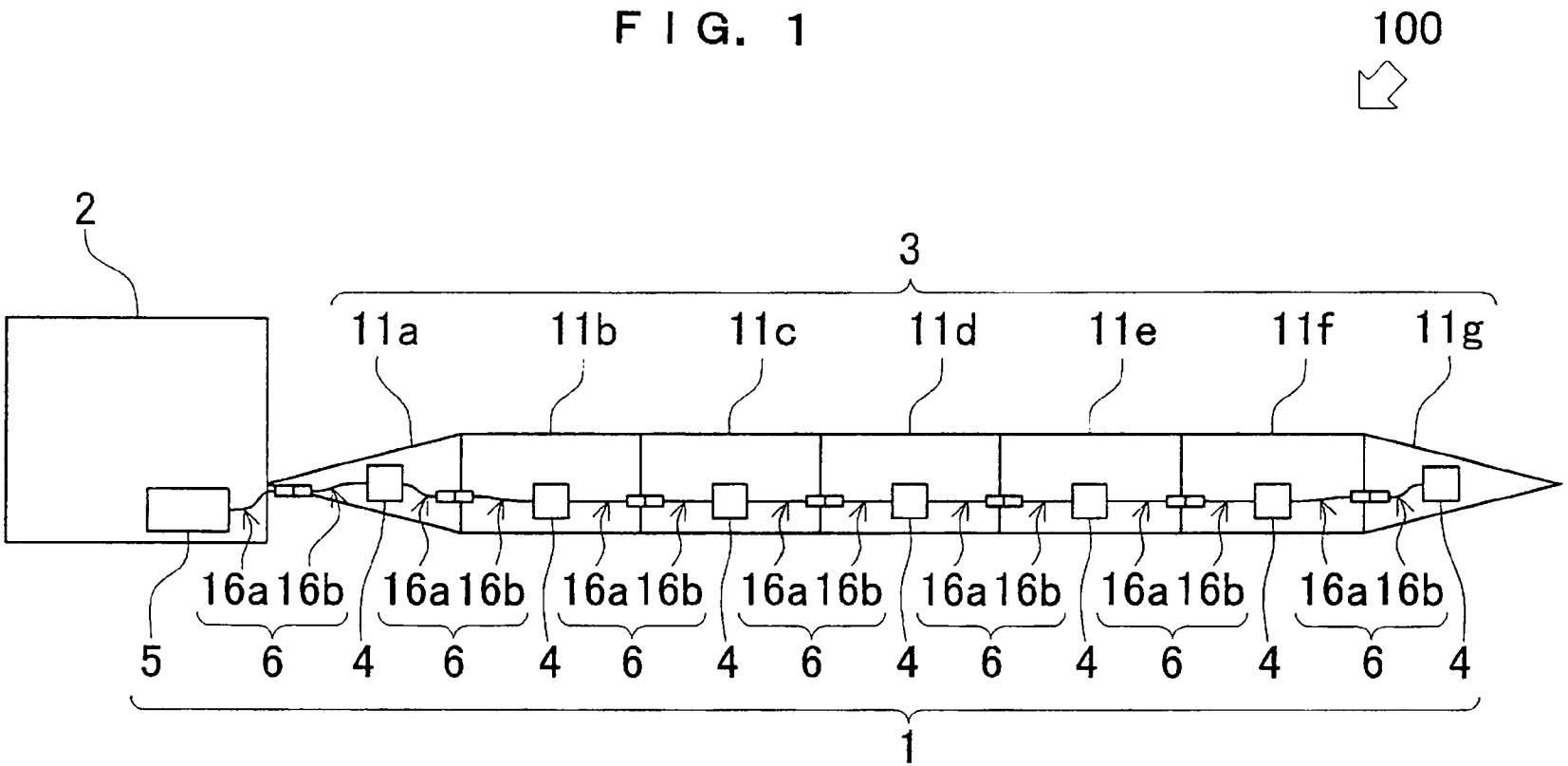
FIG. 1 is an outline view of a configuration of a crane to which a boom component display apparatus relating to the embodiment of the present invention is applied.

Hereinafter, referring to the drawings, a description is given to preferred embodiments to carry out the present invention.

Figure 2:
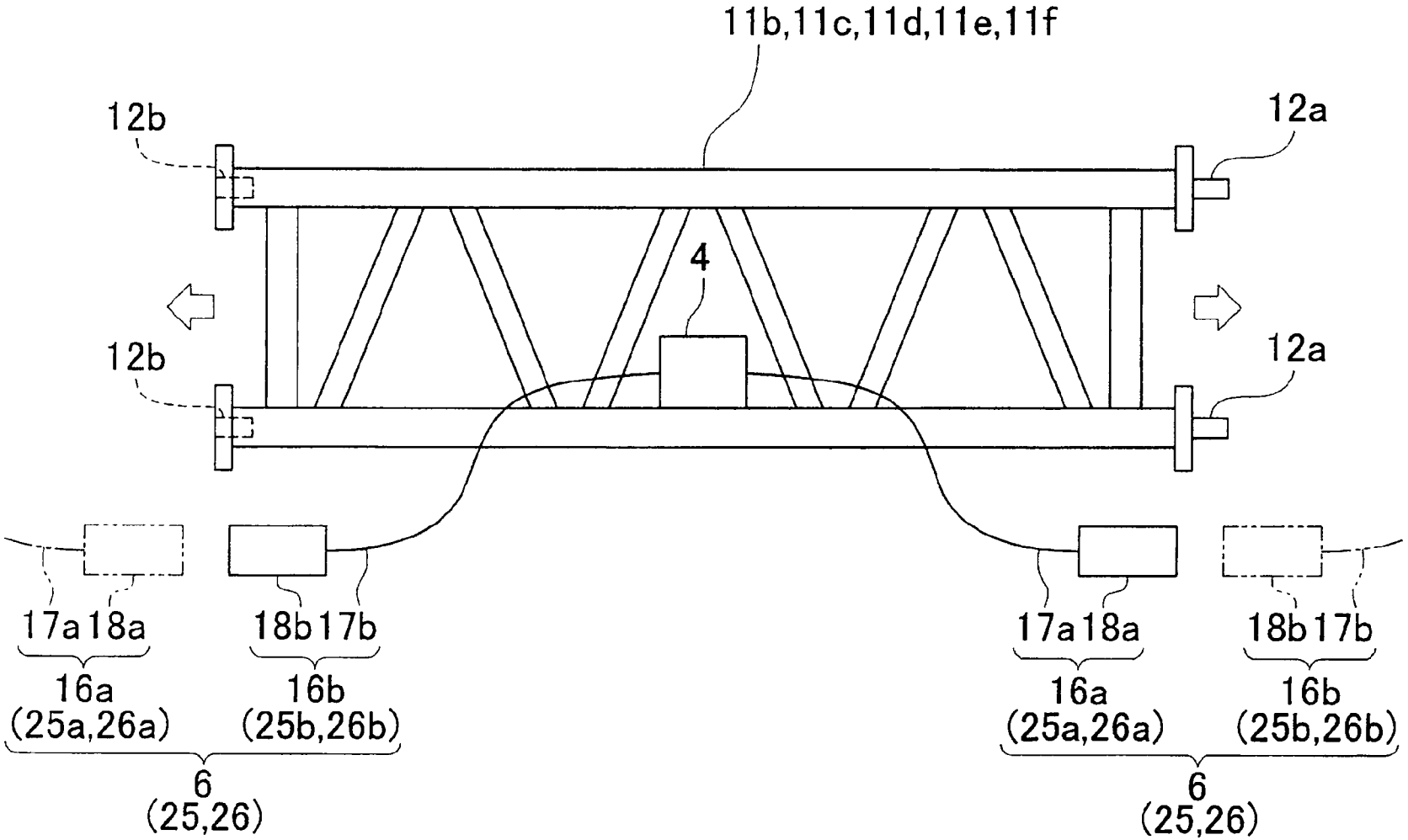
FIG. 2 is a schematic view to explain a structure of a unit boom of the crane shown in FIG. 1.
Figure 3:
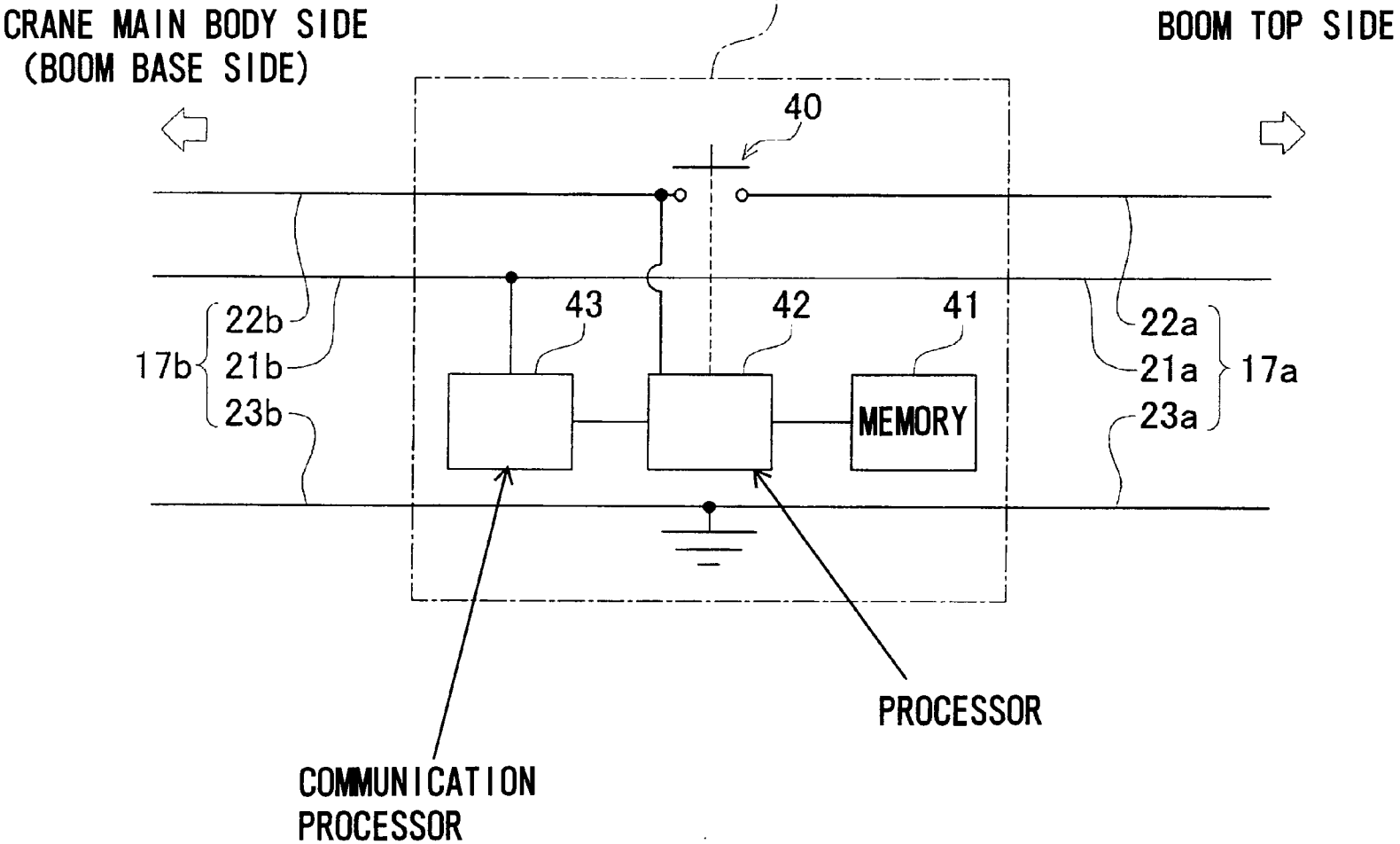
FIG. 3 is a block diagram to explain a configuration of a processing unit of the crane shown in FIG. 1.
Figure 4:
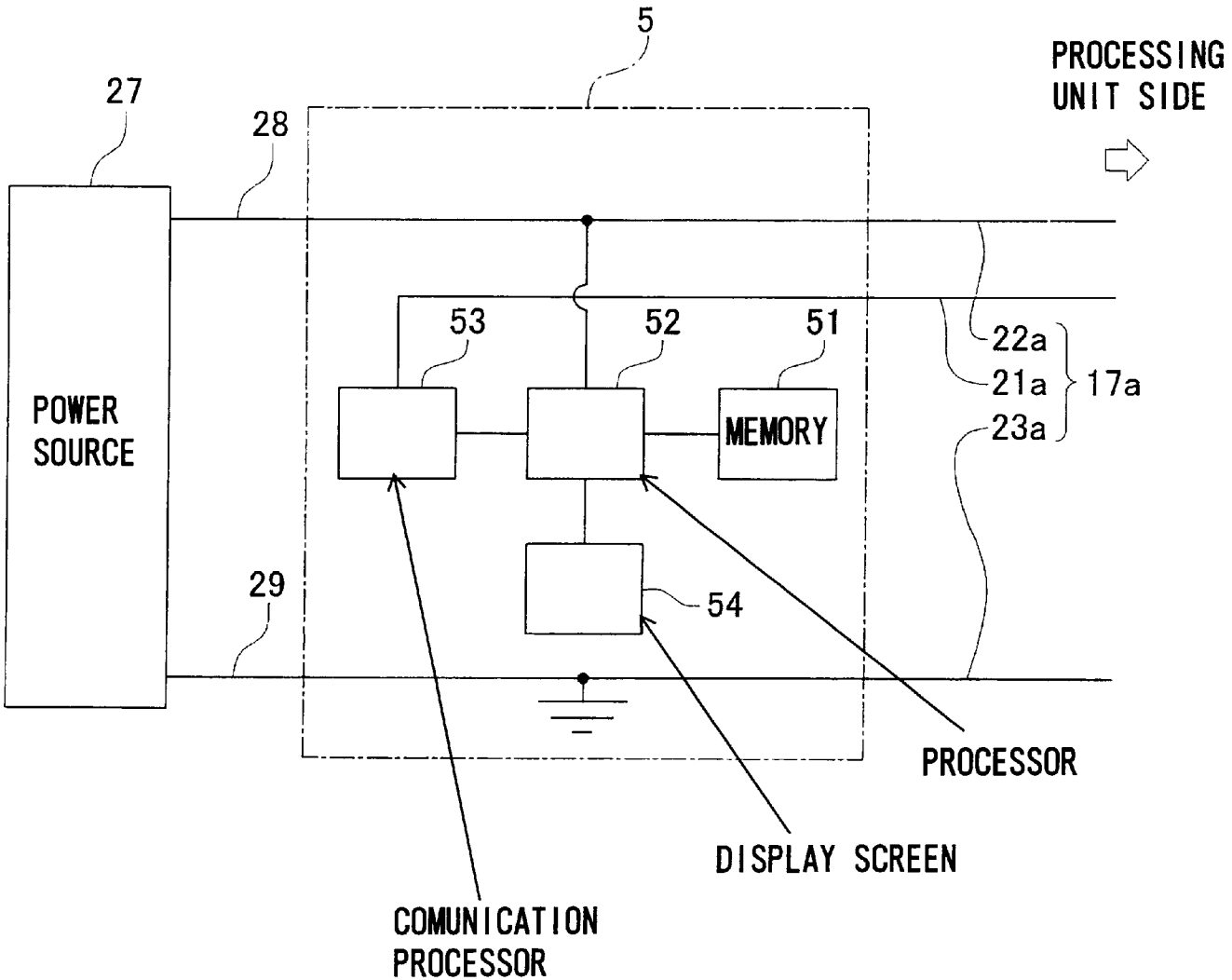
FIG. 4 is a block diagram to explain a configuration of a display unit to be installed in a crane main body shown in FIG. 1.

FIG. 1 shows an outline view of a configuration of a crane 100 to which a boom component display apparatus relating to the embodiment of the present invention is applied. FIG. 2 is a schematic view to explain a structure of the unit booms of the crane 100 shown in FIG. 1. FIG. 3 is a block diagram to explain a configuration of a processing unit 4 installed on each unit boom of the crane 100 shown in FIG. 1. FIG. 4 is a block diagram to explain a configuration of display unit 5 to be installed in a crane main body 2 shown in FIG. 1. First of all, referring to FIG. 1 thru FIG. 4, a description is given to the configuration of boom component display apparatus 1 relating to the embodiment of the present invention.

A crane 100 consists of a crane main body 2, a boom assembly 3 that is so arranged as to mount on the relevant crane main body 2 at its base section that also functions as a fulcrum for raising and lowering the boom, and a boom component display apparatus 1.

The boom component display apparatus 1 is provided with the processing units 4, a display unit 5 and connecting assemblies 6. The connecting assemblies 6 function information communicating means as well as power source connecting means.

The main boom assembly 3 is composed of a plurality of unit booms consisting of a boom base section 11*a*, a No. 1 intermediate boom section 11*b* thru a No. 5 intermediate boom section 11*f* and a boom top section 11*g*. The boom base section 11*a* is the unit boom that is located at the boom base and mounted on the crane main body 2. The boom top section 11*g* is the unit boom located at farthest end of the boom assembly 3. The No. 1 intermediate boom section 11*b* thru the No. 5 intermediate boom section 11*f* are the unit booms installed between the boom base section and the boom top section. The boom base section 11*a*, the No. 1 intermediate boom sections 11*b* thru the No. 5 intermediate boom section 11*f* and the boom top section 11*g* are arranged and connected in such a sequence that starts with the crane main body 2 and ends in the top end of the boom assembly 3.

The unit booms consist of the boom base section 11*a*, the No. 1 intermediate boom section 11*b* thru the No. 5 intermediate boom section 11*f* and the boom top section 11*g*. Each unit boom is fabricated into a lattice structure with a plurality of frameworks. As shown in FIG. 2, the No. 1 intermediate boom sections 11*b* thru the No. 5 intermediate boom section 11*f* form a shape of a box construction with the main four chords, which are located on each corner of near quadrangle pillar and sub chords which interconnect the adjacent main chords. Connecting pins 12*a* are provided on each unit boom at the side of boom top of the boom assembly 3. On the contrary, the other end of each unit boom is provided with connecting pin holes 12*b* at the side of the crane main body 2.

The connecting pins 12*a* on each unit boom are inserted into the pin holes 12*b* of the adjacent unit boom at the side of the boom top of the relevant boom assembly 3. In the connecting pin holes 12*b* of each unit boom, the connecting pins 12*a* of the other adjacent unit boom located at the side of the crane main body 2 are inserted. As the connecting points (pin 12*a* and hole 12*b*) of each intermediate section 11*b* thru 11*f* are manufactured physically in accordance with the same manufacturing standard, they are interchangeably replaceable with each other. Moreover, it is possible to re-arrange the boom assembly 3 to shorten its whole length by removing one piece of intermediate boom section, and it is also possible to lengthen the boom assembly 3 by inserting an additional intermediate boom section with the joints that are manufactured basing on the same standard A processing unit 4 is installed on each unit boom. The processing unit 4 can output various kinds of identification information of the unit boom on which the relevant processing unit 4 is installed. The identification information includes weight, length, width, height, name of manufacturer, type of the unit boom, date of manufacture, compression constant, bending constant and so forth.

A display unit 5 can communicate mutually with the processing unit 4 on each unit boom. Basing on the identification information of every unit boom sent from the processing unit 4, the display unit 5 receives the information of the total length of the boom assembly 3, number of unit booms connected, and connecting sequence, and then it can display the results after processed.

Connector assemblies 6 are the parts that connect the display unit 5 and processing units 4 on each boom unit electrically in series from the side of the crane main body 2 as far as the top end of the boom assembly 3. The connector assemblies 6 are able to disconnect the display unit 5 and the processing units 4 of the boom units. The disconnected connectors connect the display unit 5 and the processing unit 4 on the boom base section 11*a* that is located next to the display unit 5 electrically, and then connects those processing units 4 on each unit boom connected to the next one with each other electrically.

As shown in FIG. 2, a connector assembly 6 consists of a top side connecting part 16*a* and base side connecting part 16*b*. Specifically, the top side connecting part 16*a* consists of the top side cable 17*a* which extends from the display unit 5 or the processing unit 4 on each unit boom to the top side of the boom assembly 3, and the top side connector 18*a* which is installed on the end of a cable 17*a* at the side of the top end of the boom assembly 3. On the other hand, the base side connecting part 16*b* consists of the base side cable 17*b* which extends from the processing unit 4 on each unit boom to the side of the crane main body 2, and the base side connector 18*b* that is installed on the base side cable 17*b*, As shown in FIG. 3, the top side cable 17*a* includes a top side communication line 21*a*, a top side power supply line 22*a* and a top side GND (electric potential to grounding) line 23*a*. The base side cable 17*b* includes a base side communication line 21*b*, a base side power supply line 22*b* and a base side GND line 23*b*.

Inside of each processing unit 4, the end of the top side communication line 21*a* at the side of the crane main body 2 and the end of the base side communication line 21*b* at the side of the boom assembly 3 are connected electrically.

The end of a top side power supply line 22*a* at the side of the crane main body 2 and that of a base side power supply line 22*b* at the top side of the boom assembly 3 are connected electrically through a relay 40. When the relay 40 is turned ON, the top side power supply line 22*a* and base side power supply line 22*b* are connected electrically, and when it is turned OFF, the top side power supply line 22*a* and base side power supply line 22*b* are disconnected electrically. This ON/OFF motion of the relay is controlled by a relay signal, that is sent from an after mentioned processor 42 installed in each processing unit 4.

The end of the top side GND line 23*a* at the side of the crane main body 2 and that of the base side GND line 23*b* at the top side of the boom assembly 3 are connected electrically.

The top side communication part 25*a* consists of the top side communication line 21*a* and top side connector 18*a*, and the base side communication part 25*b* consists of the base side communication line 21*b* and base side connector 18*b*. The top side power supply part 26*a* consists of the top side power supply line 22*a* and the top side connector 18*a*, and the base side power supply part 26*b* consists of the base side power supply line 22*b* and the base side connector 18*b*.

The top side connector 18*a* that is connected to the display unit 5 and the base side connector 18*b* that is connected to the processing unit 4 on the boom base section 11*a* are connected detachably with each other. The top side connector 18*a* and the base side connector 18*b* that are connected to the respective processing unit 4 on each adjacent unit boom are also connected detachably with each other. As these connectors are connected, the top side connecting part 16*a* (top side communication connecting part 25*a*, top side power supply part 26*a*) that is connected to the display unit 5 and the base side connecting part 16*b* (base side communication part 25*b*, base side power supply part 26*b*) that is connected to the processing unit 4 on the base section 11*a* are connected detachably with each other. The top side connector 16*a* (top side communication part 25*a*, top side power supply part 26*a*) and the base side connecting part 16*b* (base side communication part 25*b*, base side power supply part 26*b*) that are connected to the respective processing unit 4 on each adjacent unit boom are connected detachably with each other.

Through the top side communication part 25*a* and the base side communication part 25*b*, the display unit 5 and the processing unit 4 on the boom base section 11*a*, or the processing units 4 on adjacent unit booms are mutually connected electrically in series. Each top side communication part 25*a* and base side communication part 25*b* that is arrayed between the display unit 5 and each processing unit 4 make up a communication part 25. The communication part 25 transmits the identification information from the processing unit 4 on each unit boom to the display unit 5, and also the control signals are transmitted to each processing unit 4 on the unit booms. Furthermore, in the case of the present embodiment, this communication part 25 functions as information transmit means.

Through the top side power supply part 26*a* and base side power supply part 26*b*, the display unit 5 and the processing unit 4 on the boom base section 11*a*, or the processing unit 4 on the unit booms that are adjacent each other are mutually connected electrically in series. As shown in FIG. 4, the crane main body 2 is provided with a power source 27 that supplies electric power for the display unit 5 and each processing unit 4 to drive them. A power supply line at the power source side 28 and the GND line 29 are electrically wired from the power source 27 to the display unit 5. Each top side power supply part 26*a*, each base side power supply part 26*b* and a power supply line 28 at the power source side that are arrayed between the display unit 5 and each processing unit 4 make up the a power supply part 26. The power supply part 26 sends electric power from a power source 27 to the processing unit 4 on each unit boom through the display unit 5. In addition, in the case of the present embodiment, the power supply part 26 functions as a power source connecting means.

Furthermore, as described above, in the processing unit 4 on each unit boom, the top side power supply line 22*a* and the base side power supply line 22*b* are connected through the relay 40. For this reason, in case of the relay 40 being in ON position, the electric power is supplied from the base side power supply line 22*b* to the top side power supply line 22*a* through the relay 40. On the other hand, in case of the relay 40 being in OFF position, the electric power is not supplied from the base side power supply line 22*b* to the top side power supply line 22*a*

From the power source 27, the GND electrical potential (earth electric potential) is supplied to the display unit 5 through the GND line 29. Further, through the top side GND line 23*a*, the top side connectors 18*a*, the base side connectors 18*b* and the base side GND line 23*b*, the GND electrical potential is supplied to each processing unit 4 on each unit boom.

A construction of the processing unit 4 on each unit boom and that of the display unit 5 is described hereinafter.

As shown in FIG. 3, the processing unit 4 on each unit boom is provided with a memory 41, a processor 42 and a communication processor 43 in addition to the relay 40. The memory 41 is electrically connected to the processor 42. The processor 42 is electrically connected to the top side communication line 21*a* and the base side communication line 21*b* through the communication processor 43.

The memory 41 stores the identification information of the unit boom on which the processing unit 4 is installed together with the memory 41. The memory 41 holds its memory contents even without electric power being supplied and consists of memory devices like flash memories that can rewrite their memory contents. The identification information stored in the memory 41 consists of the weight, length, width, height, name of manufacturer, type and date of manufacture of the unit boom, and parameters relating to the property of the unit boom that is compression constant and bending constant and so forth.

The processor 42 handles several kinds of processes like sending the identification information stored in the memory 41 to the display unit 5, and putting the relay 40 in the ON position by sending a relay control signal to the relay.

The communication processor 43 reads various kinds of control signals sent through the communication part 25 and transmits them to the processor 42. On the contrary, the communication processor 43 sends the identification information read out of the memory 41 by the processor 42 to the display unit 5 through the communication part 25. The processor 42 and the communication processor 43 are driven by electric power supplied through the power supply part 26, and accordingly the above mentioned processes can be carried out.

As shown in FIG. 4, the display unit 5 is provided with a memory 51, a processor 52, a communication processor 53 and a display screen 54. The memory 51 and the display screen 54 are connected electrically to the processor 52. The processor 52 is connected electrically to the top side communication line 21*a* through the communication processor 53.

The memory 51 stores the identification information and the other various kinds of information that are sent from the processing units 4 on each unit boom. The processor 52 handles several kinds of processes such as outputting control signals basing on the information stored in the memory 51, so that the display screen 54 may generate predetermined images on it. The communication processor 53 handles the communication processing such as reading the identifying signals sent from the processing units 4 on each unit boom through the communication part 25. The display screen 54 which is composed of a liquid crystal monitoring panel for example displays various kinds of information on the screen basing on the commands made by the processor 52, so that an operator may identify them visually on it.

Hereinafter, by the boom component display apparatus relating to the embodiment of the present invention, it is given a description about a process how to judge a connecting order of the unit booms forming the boom assembly 3.

First of all, as soon as a power switch is placed in the ON position, the power source 27 supplies electric power to the display unit 5 through the power supply line at the power source side 28, and also to the processing unit 4 on the boom base section 11*a* through the power supply part 26. Because of this process, the display unit 5 and the processing unit 4 on the boom section 11*a* start to operate. At this moment, as the power is not supplied to the processing units 4 on all the boom units except for the one on the boom base section 11*a*, those processing units 4 are not in operation.

The processor 42 of the processing unit 4 in operation on the boom base section 11*a* sends the identification information stored in the memory 41 in itself to the display unit 5 through the communication processor 43. The display unit 5 receives the identification information and stores it into the memory 51. At this time, the processor 52 stores the information of the receiving order of the identification information transmitted from the processing unit 4 on the boom assembly 3 into the memory 51 correlating it with the relevant identification information received. In this case, the identification information identified as the first receiving order is the one, namely being the boom base section 11*a*. Thereafter, the processor 52 sends a signal to show that receiving the information has completed (hereinafter called the data receipt signal) to the processing unit 4 on the boom base section 11*a*. When the processor 42 in the processing unit 4 on the boom base section 11*a* receives the data receipt signal form the display unit 5, it switches the relay 40 to the ON position. Then, the electric power is supplied to the processing unit 4 on the No. 1 intermediate boom 11*b* connected next to the boom base section 11.

The processing unit 4 on the No. 1 intermediate boom 11*b* to which electric power is supplied sends the identification information stored in the memory 41 in itself to the display unit 5 through the communication processor 43, like the processing unit 4 on the boom base section 11*a*. The display unit 5 receives the identification information, and after storing the relevant identification information and its receiving order into the memory 51, it sends the data receipt signal to the processing unit 4 on the No. 1 intermediate boom 11*b*. In this case, the information of the receiving order is for the second one, namely the information of the No. 1 intermediate boom 11*b*. When the processor 42 in the processing unit 4 on the No. 1 intermediate boom 11*b* receives the data receipt signal form the display unit 5, it switches the relay 40 to the ON position.

Hereinafter, similarly, in the order of the No. 2 intermediate boom 11*c*, the No. 3 intermediate boom 11*d*, the No. 4 intermediate boom 11*e*, the No. 5 intermediate boom 11*f* and the boom top section 11*g*, the identification information of each unit boom is sent to the display unit 5.

Incidentally, the identification information of the boom top section 11*g* includes a data showing to be of the unit boom that is located at the top section of the boom assembly 3. In consequence of this, after the identification information of the boom top section 11*g* is sent to the display unit 5, the display unit 5 recognizes that the identification information of all the unit booms composing the boom assembly 3 has been received.

On the display screen 54 of the display unit 5, there is shown the identification information sent from each processing unit 4 and stored in the memory 51, and there is also shown the connecting sequence information of the unit boom that shows the relation between the identification information of the plurality of relevant unit booms and the connecting sequence information of the plurality of the unit booms forming the boom assembly 3, basing on receiving order of the information from each unit boom.

An example of the illustrations of the information showing the connecting sequence of the relevant unit booms on the display screen 54 of the display unit 5 is explained hereinafter.

The First Example of Display

Figure 5:
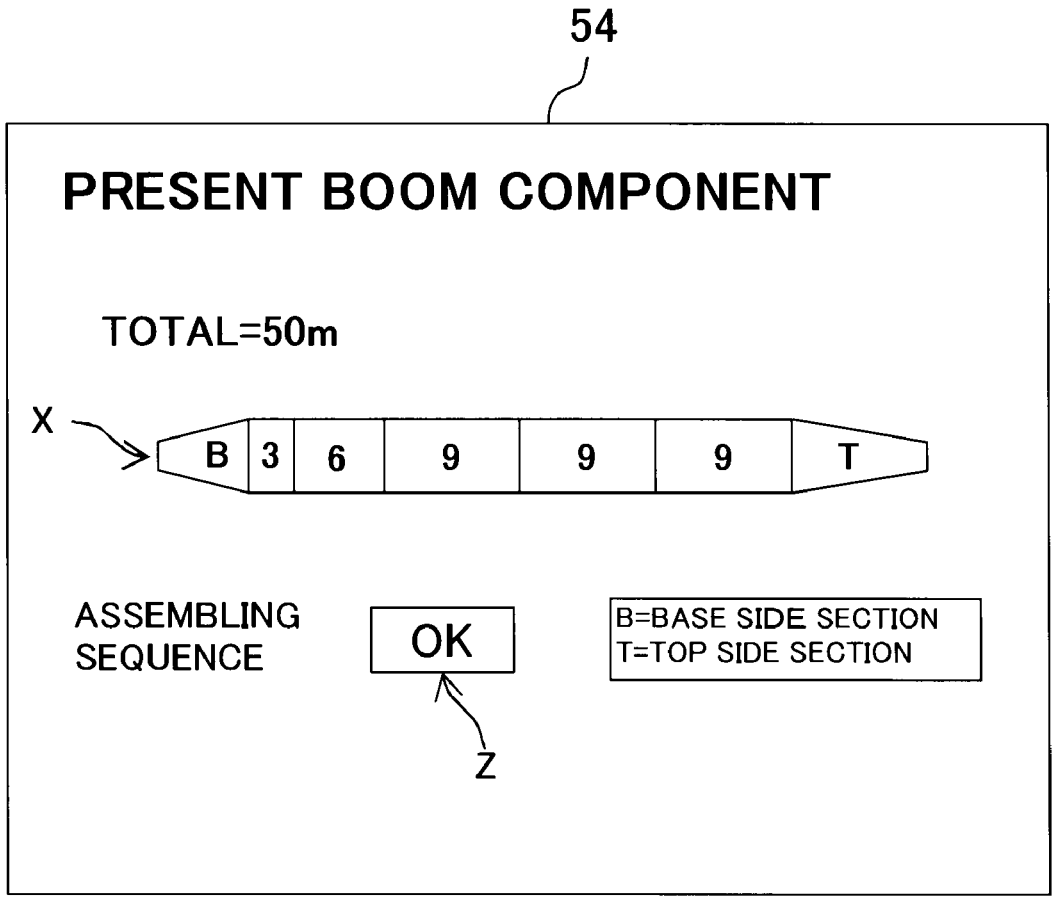
FIG. 5 is a schematic illustration showing the first example of a display screen of the connecting sequence information of the unit booms.

FIG. 5 is an illustration showing the first example of the display screen of the connecting sequence information of unit booms. In the first example, the information of "the unit boom length" is displayed around in the middle of the screen in the vertical direction and also from left to right on the display screen 54, based on the order in which the identification information is transmitted from processing units 4 of unit booms. Each unit boom (intermediate boom 11*b* thru 11*f*) except for the boom base section 11*a* and the boom top section 11*g* is shown in a shape of rectangle. Moreover the numerals showing the length of each unit boom are shown inside the relevant rectangles. Furthermore, the rectangles are shown on the screen so that a ratio of the lengths of each rectangle in the right and left direction corresponds to that of the lengths of the relevant unit booms.

As shown in FIG. 5, by viewing a boom arrangement X on the display screen 54, an operator can visually recognize what combination of the lengths of unit booms are selected and in what sequences they are arranged between the boom base section 11*a* and boom top section 11*g*. That is to say; by viewing the display screen 54, it can be recognized that the arranged row of the unit booms is the boom base section 11*a*, then the unit booms of the length of 3 meters, 6 meters, 9 meters, 9 meters and 9 meters.

In addition to showing the lengths of each unit boom, the total length of the boom assembly 3 is also displayed on the screen. The total length of the boom assembly 3 is calculated by adding up "the length of the unit boom" stored in the identification information sent to the display unit 5 from the processing unit 4 on each unit boom.

Figure 6:
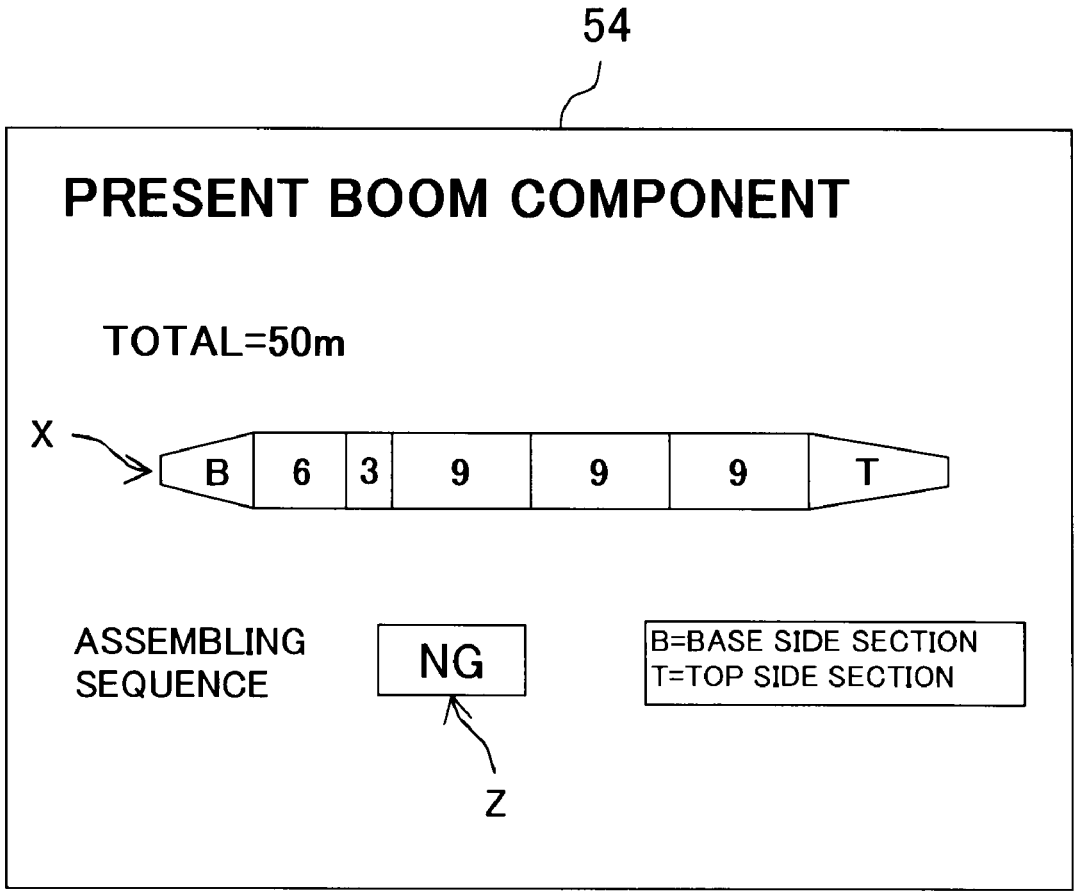
FIG. 6 is a schematic illustration showing an example of the improper connecting sequence of the unit booms.

Moreover, if the connecting sequence of the intermediate unit booms between the boom base section 11*a* and boom top section 11*g* is appropriate for the boom assembly, "OK" sign is displayed on the screen at a position of a sign Z located under the pictorial display of the boom length. If it is inappropriate, "NG" sign is displayed instead. FIG. 5 shows an example when the connecting sequence of the unit boom is appropriate, and when the connecting sequence of the unit booms is not appropriate, "NG" sign is displayed at the sign spot of Z as shown in FIG. 6.

The judgment whether a connecting sequence of the unit booms concerned is appropriate or not is made as explained hereinafter.

The data showing an appropriate connecting sequence of the unit booms for prescribed lengths of the boom assembly are stored previously in the memory 51 of the display unit 5. In this case, the appropriate connecting sequence of the unit booms means the relation between the lengths of the unit booms and the sequences by which they are connected, and also functions as reference connecting sequence information. In the memory 51 for example, an appropriate connecting sequence for the boom assembly 3 of which total length happens to be 50 meters (hereinafter called "allowable connecting sequence data 50M") is stored in a tabulated form. FIG. 7 shows the allowable connecting sequence data 50M. As shown in FIG. 7, in the case of the present embodiment, three kinds of the prescribed boom lengths and connecting sequence of their unit booms (shown as the pattern 1, pattern 2 and pattern 3) are stored appropriate. Moreover, although it is not illustrated, the data of appropriate connecting sequence for the total length of the boom assembly 3 which is shorter than 50 meters (40 meters, 30 meters and so forth) or longer than 50 meters (60 meters, 70 meters and so forth) are stored in the memory 51 likewise.

First of all, the processor 52 in the display unit 5 calculates the total length of the boom assembly 3 by adding up every "length of the unit boom" included in the identification information sent to the display unit 5. In the case of the present embodiment, the total length of the boom assembly 3 is 50 meters. The processor 52 reads out of the memory 51 the data of the appropriate connecting sequence (allowable connecting sequence data 50M) that comply with the total length of the relevant boom assembly 3. Next, the processor 52 compares the relation between the length of each unit boom and the connecting sequence of relevant unit boom basing on the information sent from each processing unit 4, with the relation between the length of each unit boom and the connecting sequence of relevant unit boom basing on the relevant allowable connecting sequence data 50M.

If the relation between the length of each unit boom and the connecting sequence of relevant unit booms basing on the information sent from each processing unit 4 corresponds to any of three patterns (i.e. pattern 1, pattern 2 and pattern 3) of the relation between the length of each unit boom and the connecting sequence of relevant unit booms basing on the relevant allowable connecting sequence data 50M, the processor 52 recognizes the connecting sequence of the unit booms is appropriate and shows OK sign on the display screen 54.

On the other hand, if the relation between the length of each unit boom and the connecting sequence of relevant unit booms basing on the information sent from each processing unit 4 does not comply with any of three patterns of relation between the length of each unit boom and the connecting sequence of relevant unit booms basing on the relevant allowable connecting sequence data 50M, the processor 52 recognizes the connecting sequence of unit booms is not appropriate and shows NG sign on the display screen 54.

The Second Example of Display

Figure 8:
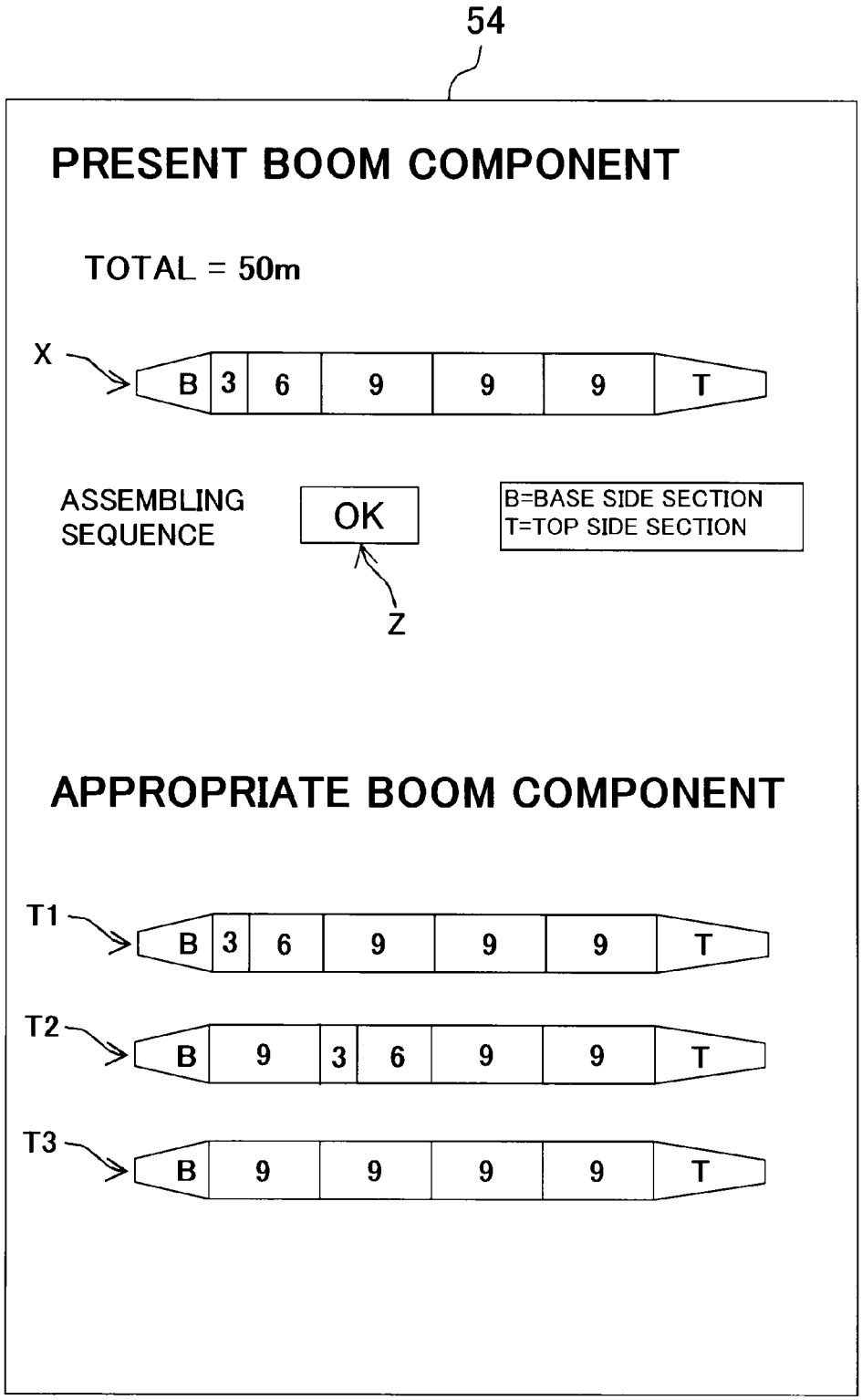
FIG. 8 is a schematic illustration showing the second example of the display screen of the connecting sequence information of the unit booms.

FIG. 8 is an illustration showing the second example of a display screen of the connecting sequence information of the unit booms. In the second example, the upper half of the display screen 54 shows the same illustrations as explained in the first example. In addition, in the lower half of the display screen 54 shows a boom arrangement basing on the data of an appropriate connecting sequence for the total length of the boom assembly 3. That is to say; in the case of the present embodiment, three kinds of the boom arrangements T1, T2, and T3 basing on the data (allowable connecting sequence data 50M) of the appropriate connecting sequence for the case that the total length of the boom assembly 3 is 50 meters are displayed on the screen.

Figure 9:
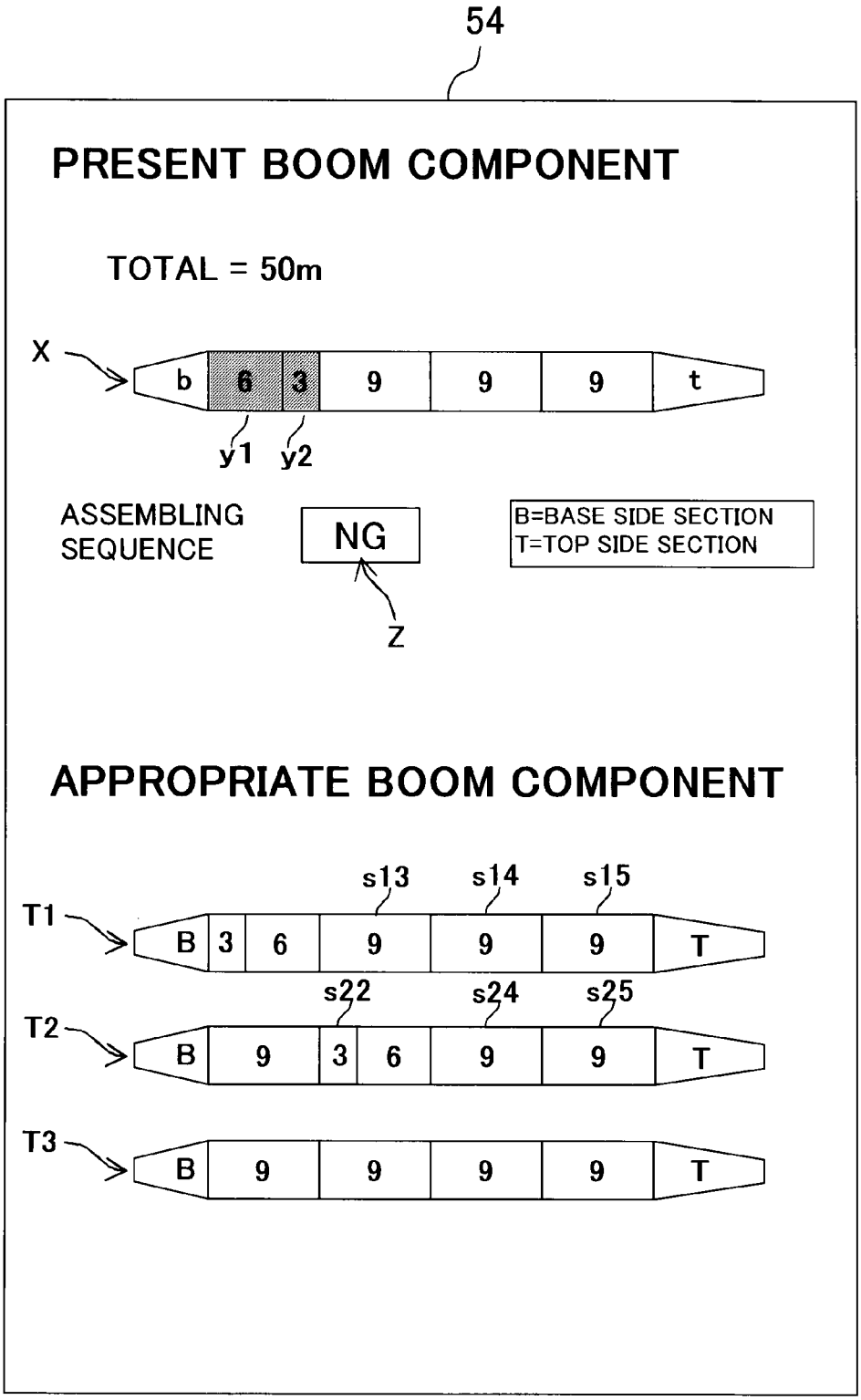
FIG. 9 is a schematic illustration showing the example of the improper connecting sequence of the unit booms.

FIG. 8 shows a case as an example that the connecting sequence is appropriate, however, if the connecting sequence of the unit booms is not appropriate, as shown in FIG. 9, NG sign is displayed on the spot where the connecting sequence is displayed. Further, for a boom arrangement X which shows the relation between the length of each unit boom and the connecting sequence of relevant unit booms basing on the information sent from each processing unit 4, unit boom, of which connecting sequence is different from the appropriate connecting sequence, is highlighted by blinking on the screen. Furthermore, not only high-lighting, but also different colors may be used for improper arrangements of the unit booms.

In the display of the boom arrangement X, the blinking unit booms are, for example, selected as follows.

First of all, when there are a plurality number of appropriate boom arrangements available, the arrangement which is the closest to that of the boom assembly 3 is selected among them for a reference boom arrangement. For example, from the several viewpoints such as the number of the unit booms forming a boom assembly, the number of the unit booms with the same boom length, the same boom arrangement and so forth, the boom arrangement that is the closest to that of the boom assembly 3 is selected for the reference boom arrangement.

In the case of the present embodiment, as there are three kinds of appropriate boom arrangements (boom arrangement T1, T2 and T3) available, the arrangement which is the closest to that of the boom assembly 3 is selected among them for the reference boom arrangement. In the concrete, comparing the boom arrangement X of the boom assembly 3, the boom arrangement T1 (refer to FIG. 9) of which number of the unit booms between the boom base section and boom top section is five, that is the same as those of X, and the length of three kinds of the unit booms (s13, s14 and s15) and their connecting sequences are also the same as X is selected for the reference boom arrangement. Also in the case of the boom arrangement T2, the length and connecting sequence of three unit booms (s22, s24 and s25) is the same, but among those boom arrangements of which number of the unit booms is the same, the boom arrangement of which added up boom length is the longest one is selected preferentially.

That is to say; in the case of the boom arrangement T1, an added up length of the unit booms s13, s14 and s15 to compose the boom assembly of which length and boom arrangement are the same in comparison with the boom arrangement X is 27 meters, while in the case of the boom arrangement T2, the added up length of the unit booms s22, s24 and s25 to compose the boom assembly of which length and arrangement are the same in comparison with the boom arrangement X is 21 meters. Therefore, the boom arrangement T1 is selected for the reference boom arrangement. In the boom arrangement X of the boom assembly 3, the unit booms (y1, y2) which are different connecting sequence from the ones for the boom arrangement T1 for the reference boom arrangement are highlighted by blinking on the screen. In addition, the areas highlighted by blinking on the screen are shown by the diagonally shaded areas in FIG. 9.

As explained above, the boom component display apparatus 1 relating to the embodiment of the present invention is provided with the processing unit 4 that is installed on each of a plurality of unit booms forming the boom assembly of the crane 100, the processing unit 4 that outputs the identification information of each unit boom, the communication part 25 that transmits the identification information sent from the processing unit 4, and the display unit 5 that receives the identification information from the processing unit 4 through the communication part 25 and displays the connecting sequence information of the unit boom showing the relation between the connecting sequence of the plurality of unit booms and the length of the plurality of relevant unit booms.

According to this configuration, the display unit 5 displays the connecting sequence of the plurality of the unit booms that shows the relation between the connecting sequence of the plurality of the unit booms forming the boom assembly 3 and the lengths of the unit booms. Therefore, an operator can visually recognize in what sequence the unit booms with the prescribed length are connected. Accordingly, the operator can easily judge whether the appropriate connecting sequence has been made or not, and prevent the unit booms from being connected in the wrong connecting sequence.

Furthermore, in the case of the present embodiment, the display unit 5 shows the length of the unit boom on the screen. However, not limiting to this case, the display unit 5 can show other information than that of the length of the unit booms that is sent from the processing unit 4 to the display unit 5 as the identification information. For example, it is possible to display the weight of the unit boom, length, width, height, name of manufacturer, type of the unit boom, date of manufacture, compression constant, bending constant and so forth that are the parameters relating to the property of the unit boom together with its length or separately.

It is also possible to make up the display unit 5, so that an operator may change the image of information on the screen of the display unit 5 by conducting predetermined operation. In this case, the display unit 5 can give the operator more information without enlarging the size of the display screen 54.

Not only making up the communication part 25 by using the communication means like wired, but also it is possible to make up the communication part 25 by using wireless system to transmit the information.

Moreover, in the case of the present embodiment, the power supply part 26 connected electrically in series to the power source 27 is also provided in order to connect the processing unit 4 on each unit boom from the side of the boom base section of the boom assembly 3 to the side of boom top section in turn. Being connected to the power supply part 26 electrically, the processing unit 4 is provided so as to output the identification information of the unit boom on which the relevant processing unit 4 is installed. The display unit 5 displays the connecting sequence information of the unit boom on the screen, taking the order of the information transmitted from the processing unit 4 through the communication part 25 for the connecting order of the unit boom on which the processing unit 4 is provided with the memory 41 where the identification information of unit boom is stored.

In this arrangement, as the power supply part 26 connects the processing unit 4 on each unit boom from the side of the boom base section of the boom assembly 3 to the side of the boom top section electrically in turn, the identification information is transmitted to the display unit 5 successively, starting with the boom unit located next to the crane main body 2. Taking the order of the information transmittal for the connecting order of unit boom, the display unit 5 can display the relation between the identification information and the connecting sequence. In this case, with this simple configuration, it is possible to gain the relation between the identification information of unit boom and the connecting sequence of the relevant unit boom.

The display unit 5 displays numerals showing the lengths of the unit booms in the same order as the relevant connecting order of the unit booms.

According to this configuration, as the lengths of the plurality of the unit booms and their connecting sequence are displayed in the same order, the connecting sequence can be visually recognized with ease. Therefore, an operator can easily recognize the connecting sequence of the unit booms is appropriate or not.

Further, in the case of the present embodiment, on the display screen 54, the rectangles representing each unit boom are shown, so that a ratio of the lengths of each rectangle in the right and left direction correspond to that of the lengths of the relevant unit booms. Accordingly, an operator can recognize the lengths of the unit booms and their connecting sequence graphically, that facilitates the judgment whether the connecting sequence of the unit boom is appropriate or not.

In addition, the present invention is not limited to the embodiment displaying the identification information of the plurality of unit booms in the same order as the connecting sequence of the unit booms. For example, the boom component display apparatus can be arranged, so that the comparison of the identification information of the plurality of unit booms sent from the processing unit 4 with the connecting sequence of the plurality of unit booms may be displayed in a manner as shown in a tabulated worksheet form on the display screen 54.

The display unit 5 is provided with the memory 51 which stores the reference connecting sequence information that shows the relation between the connecting sequence of the plurality of the unit booms and the length of the plurality of relevant unit booms, and compares the connecting sequence information of the unit booms with the reference connecting sequence information, and then if there exists any discrepancy between both of them, the predetermined warning sign is displayed on the screen. That is to say; if any discrepancy exists, "NG" sign is displayed at the sign spot Z on the display unit 5.

In the case of the present embodiment, the relation specifying the appropriate connecting sequence of the unit boom is stored for the reference connecting sequence information in the memory 51 of the display unit 5. Therefore, when the connecting sequence is not appropriate, a warning sign ("NG" sign) is displayed by the display unit 5. Because of this, an operator can recognize immediately that the connecting sequence of the unit booms that compose a boom assembly 3 is not appropriate. In addition, the display unit 5 can be arranged, so that a warning alarm may sound together with the warning sign. In this case, it is possible to let an operator know more definitely that the connecting sequence of the unit booms composing the boom assembly 3 is not appropriate.

Further, as shown in FIG. 8 and FIG. 9, in the second example of the display, the display unit 5 displays the boom arrangements T1 thru T3 for the reference connecting sequence information together with the boom arrangement X for the connecting sequence information of the unit boom on the screen, therefore an operator can view both the boom arrangement X and the boom arrangements T1 thru T3 simultaneously, and compare the boom arrangement X with the boom arrangements T1 thru T3. Because of this, the judgment made by the operator whether the connecting sequence of the unit boom is appropriate or not becomes much easier.

Furthermore, in the second example of the display shown by FIG. 8 and FIG. 9, the outline of a unit boom of which connecting sequence is not appropriate in the boom arrangement X to compose a boom assembly 3 is displayed differently from the other unit booms on the screen. In the case of the present embodiment, the outline of the unit booms of which connecting sequence is not appropriate is highlighted by blinking on the screen. Because of this, an operator can recognize easily which connecting sequence of the unit booms is not appropriate.

Although the invention has been described with reference to the preferred embodiment in the attached figures, it is noted that equivalents may be employed and substitutions made herein without departing from the scope of the invention as recited in the claim.

I claim:

1. A boom component display apparatus, comprising:

processing units provided on each of a plurality of unit booms that compose a boom assembly of a crane, said processing units outputting identification information of said unit booms;

information transmit means for transmitting said identification information outputted from said processing units; and a display unit to which said identification information outputted from said processing unit is transmitted through said information transmit means, said display unit being provided with a memory storing reference connecting sequence information and displaying connecting sequence information of the connecting order of said unit booms, said connecting sequence information showing a relation between the connecting sequence of the plurality of said unit booms and said identification information of the plurality of said unit booms, wherein said display unit displays said reference connecting sequence information.

2. The boom component display apparatus according to claim 1, further comprising:

a power source connecting means which connects said processing units electrically in series to an power source from a side of a boom base section to a side of a boom top section of said boom assembly.

3. The boom component display apparatus according to claim 1, wherein said display unit displays said identification information of the plurality of said unit booms in the same order as the connecting order of the plurality of said unit booms.

4. The boom component display apparatus according to claim 1, wherein said display unit compares said connecting sequence information with said reference connecting sequence information, said display unit displaying a predetermined warning message in the case that any discrepancy between said connecting sequence information and said reference connecting sequence information exists.

5. The boom component display apparatus according to claim 1, wherein said processing units output the identification information of each of said unit booms, and said display unit displays said connecting sequence information of said unit booms based on an order by which said identification information is transmitted from said processing units through said information transmit means as the connecting order of the plurality of said unit booms.

* * * * *